United States Patent [19]

Ballweber et al.

[11] 4,233,411

[45] Nov. 11, 1980

[54] CATIONIC POLYMERIC COMPOSITION FOR IMPARTING WET AND DRY STRENGTH TO PULP AND PAPER

[75] Inventors: Edward G. Ballweber, Glenwood; Roger H. Jansma, Park Forest; Kenneth G. Phillips, River Forest, all of Ill.

[73] Assignee: Nalco Chemical Co., Oak Brook, Ill.

[21] Appl. No.: 37,797

[22] Filed: May 10, 1979

Related U.S. Application Data

[63] Continuation-in-part of Ser. No. 957,952, Nov. 6, 1978.

[51] Int. Cl.[3] ..... D21H 3/52; C08L 33/26

[52] U.S. Cl. ..... 525/155; 162/164 EP; 162/167; 162/168 NA; 525/158; 525/185; 525/187; 260/29.4 UA

[58] Field of Search ..... 525/185, 187, 218, 326, 525/383, 155, 158

[56] References Cited

U.S. PATENT DOCUMENTS

| | | | |
|---|---|---|---|
| 3,556,932 | 9/1971 | Coscia et al. | 162/166 |
| 3,703,563 | 11/1972 | Lipowski et al. | 525/158 |
| 4,002,588 | 1/1977 | Strazdins | 525/155 |

*Primary Examiner*—Murray Tillman
*Assistant Examiner*—A. H. Koeckert
*Attorney, Agent, or Firm*—John G. Premo; Robert A. Miller; John S. Roberts, Jr.

[57] ABSTRACT

A blend which contains homopolymers useful for imparting wet and dry strength to pulp and paper fibers which comprises a major amount of non-ionic polyacrylamide, together with glyoxal to impart crosslinking and a cationic regulator selected from the group consisting of a low molecular weight dimethyl amine epichlorohydrin copolymer, a low molecular weight ethylene dichloride ammonia condensation polymer, and a polyvinyl benzyl trimethyl ammonium chloride polymer. A buffer such as tetrasodium pyrophosphate may be used. A dosage of 0.2–5% by weight (preferred 0.5–2% by weight) based on the dry weight of fiber is utilized.

4 Claims, No Drawings

CATIONIC POLYMERIC COMPOSITION FOR IMPARTING WET AND DRY STRENGTH TO PULP AND PAPER

This application is a continuation in part of pending U.S. Ser. No. 957,952 filed Nov. 6, 1978.

The present invention relates to an improved blend which contains homopolymers useful for imparting wet and dry strength to pulp and paper fibers which comprises a major amount of non-ionic polyacrylamide, together with glyoxal to impart crosslinking and a cationic regulator or modifier selected from the group consisting of a low molecular weight dimethyl amine epichlorohydrin copolymer, a low molecular weight ethylene dichloride ammonia condensation polymer, and a polyvinyl benzyl trimethyl ammonium chloride polymer. It is noted that applicants' previous application, Ser. No. 957,952 filed Nov. 6, 1978, describes the use of a polymeric diallyldimethyl ammonium chloride (DADMAC) as a cationic modifier. A buffer such as tetrasodium pyrophosphate may be used. A dosage of 0.2–5% by weight (preferred 0.5–2% by weight) based on the dry weight of fiber is utilized.

The present invention is an improved blend primarily of polymeric materials, namely, polyacrylamide and one of the cationic regulators wherein the aldehyde glyoxal is added as a crosslinking agent for the polyacrylamide. The polyacrylamide may be utilized from commercial materials in the form of crystalline powder and with a molecular weight of about 1,000 to 500,000. The polyacrylamide is non-ionic (cf. Davidson and Sittig, *Water Soluble Resins,* II, Van Nostrand-Reinhold, 1968, page 176) and retains its non-ionic character when utilized as a component of the present invention.

The glyoxal (CHOCHO) adds to the polyacrylamide during a base catalyzed reaction in two steps as follows.

The first reaction is the adduction of glyoxal on the acrylamide backbone:

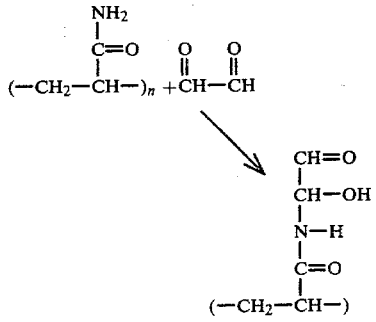

The second reaction involves the reaction of the second aldehyde with another polyacrylamide molecule.

The third component is a polymeric cationic regulator selected from the group consisting of a low molecular weight dimethyl amine epichlorohydrin copolymer, a low molecular weight ethylene dichloride ammonia condensation polymer, and a polyvinyl benzyl trimethyl ammonium chloride polymer.

A preferred composition using diallyldimethyl ammonium chloride (DADMAC) as a cationic regulator is as follows:

40–95% by weight of polyacrylamide
4–14% by weight of polydiallyldimethyl ammonium chloride 2–50% by weight of glyoxal A preferred percentile is:

64–82% polyacrylamide by weight
4–14% polydiallyldimethyl ammonium chloride by weight
9–24% glyoxal by weight It has been found in using the material on fibers that a dosage of 0.2–5% (preferred 0.5–2% of the composition is utilized based on dry weight of fiber. One additional optional component of the composition is tetrasodium pyrophosphate utilized as a buffer.

A specially preferred composition is as follows:

90 parts by weight of polyacrylamide
5–20 parts by weight of cationic regulator
10–30 parts by weight glyoxal
20 parts of sodium pyrophosphate

PRIOR ART STATEMENT

U.S. Pat. No. 3,556,932 Coscia et al (American Cyanamid). This patent deals with a glyoxalated acrylamide/DADMAC copolymer.

MIXING PROCEDURE

The polyacrylamide, glyoxal, polymeric cationic regulator, and a buffer such as tetrasodium pyrophosphate were mixed in a solution which was slightly alkaline. The mixture was held at 40° C. as the viscosity built up in the alkaline milieu. After a period of time ranging from 180 minutes to 300 minutes, the crosslinking reaction was interrupted by a so-called acid kill, using $HNO_3$ or HCl to decrease the pH from about 7.2 to about 4.0. It has been found that a minimum viscosity necessary for use in the blend is about 17 cps (range 17–55 cps) and a preferred time of crosslinking reaction is about 360 minutes at 40° C. and 7.2–8.0 pH. Where other parameters are held constant, a crosslinking time of 180 minutes produced a viscosity of 10 cps and 240 minutes produced a viscosity of 11 cps. These viscosity readings proved insufficient to achieve the desired wet strength resin effect. It was further found that aging of 15–16 days after acid killing did not substantially affect the efficiency as a wet strength resin in fibers.

As to the pH milieu, since the crosslinking is rate increased in alkaline, a mixing pH of 9.5 may be utilized, which is subsequently neutralized to about 4.0 to "kill" the reaction.

EXAMPLE 1

TABLE 1

| Resin Identification Evaluations | | | |
|---|---|---|---|
| Reference | Description | Viscosity | Age |
| B | Killed at 360 min. | 17 cps | 2, 3 days |
| C | Killed at 400 min. | 32 cps | 2, 3 days |
| D | Killed at 415 min. | 55 cps | 2, 3 days |
| A | Killed at 180 min. | 10 cps | 2, 3 days |
| E | Killed at 240 min. | 11 cps | 2, 3 days |
| F | Killed at 255 min. (pH 7.2) | 17 cps | 15,16 days |
| G | Killed at 300 min. (pH 7.2) | 48 cps | 15,16 days |

TABLE 2

| Dry Strength as Evidenced by Dry Tensile and Mullen Burst Tests | | | | | | |
|---|---|---|---|---|---|---|
| Sample | 1 ΔM | 2 ΔM | 1A ΔDT | 3 ΔDT | 3A ΔDT | Viscosity |
| H | +8.8 | | 13.1 | 38.7 | 40.5 | |
| I | +8.6 | +8.1 | 22.9 | 10.5 | 7.8 | |
| B | +8.7 | +7.0 | 35.7 | 40.1 | 42.6 | 17 cps |
| C | +12.8 | +10.2 | 42.0 | 43.6 | 46.4 | 32 cps |

TABLE 2-continued

| Sample | Dry Strength as Evidenced by Dry Tensile and Mullen Burst Tests | | | | | Viscosity |
|---|---|---|---|---|---|---|
| | ΔM | 2 ΔM | 1A ΔDT | 3 ΔDT | 3A ΔDT | |
| D | +13.2 | +7.2 | 41.5 | 41.3 | 43.4 | 55 cps |
| A | −0.4 | +1.5 | 12.7 | 2.3 | 3.4 | 10 cps |
| E | +1.9 | +0.2 | 10.4 | 12.2 | 10.5 | 11 cps |

ΔM = increase of normalized mullen (over the blank)
ΔDT = improvement of dry tensile (over the blank)
H is a glyoxalated acrylamide/DADMAC copolymer (3,556,932)
I is polyamide/polyamine/epichlorohydrin (2,926,116; 2,926,154)

From the above it can be seen that in the samples of sufficient viscosity ranging from 17 cps–55 cps and denoted Samples B, C, D, both dry tensile and mullen burst tests results show a substantial advantage over commercial resins H and I.

TABLE 3

| | Wet and Dry Tensile Tests | | | | | | |
|---|---|---|---|---|---|---|---|
| | 1.9#/T | | 7.9#/T | | 15.8#/T | | |
| | WT | ΔDT | WT | ΔDT | WT | ΔDT | Viscosity |
| H | 1.99 | 24.0 | 4.70 | 20.7 | 5.43 | 13.1 | |
| I | 2.38 | 26.3 | 5.40 | 22.7 | 5.77 | 22.9 | |
| F | 1.30 | 21.4 | 3.01 | 32.7 | 5.01 | 46.0 | 17 cps |
| D | | | | | 5.41 | 41.5 | 55 cps |
| C | | | | | 5.19 | 42.0 | 32 cps |
| B | | | | | 4.20 | 35.7 | 17 cps |
| E | | | | | 1.02 | 10.4 | 11 cps |
| A | | | | | 0.43 | 12.7 | 10 cps |

WT = normalized wet tensile
ΔDT = percent improvement of dry tensile (over the blank)
Blank dry tensile = 16.77

The interpretation of the results above shows a substantial advantage in dry tensile as evidenced by ΔDT over resins H and I at high and medium dosages.

TABLE 4

| | Dry Strength (Mullen) Improvements | | | |
|---|---|---|---|---|
| | 1.9#/T | 7.9#/T | 15.8#/T | Viscosity |
| Blank | (47.8) | | | |
| H | −4.1 | +9.2 | +8.8 | |
| I | −3.4 | +3.5 | +8.0 | |

TABLE 4-continued

| | Dry Strength (Mullen) Improvements | | | |
|---|---|---|---|---|
| | 1.9#/T | 7.9#/T | 15.8#/T | Viscosity |
| F | +4.2 | +5.7 | +9.2 | 17 cps |
| D | | | +13.2 | 55 cps |
| C | | | +12.8 | 32 cps |
| B | | | +8.7 | 17 cps |
| E | | | +1.9 | 11 cps |
| A | | | −0.4 | 10 cps |

Mullen tests above show substantial advantage of compositions of the present invention such as D and C at 15.8 lbs/T (0.8 wt. percent).

EXAMPLE 2

Procedure for Runs 1–10

Resin Preparation:

A mixture of polyacrylamide, polyDADMAC, tetrasodium pyrophosphate and water was prepared. To this was added glyoxal. The pH was immediately adjusted to 9.1 and the sample placed in a 25° C. water bath. At the indicated time, a sample was withdrawn for immediate testing.

Paper Preparation:

A sample of resin to yield 1% resin dosage based on fiber was mixed with a dilute paper fiber slurry (1%) and allowed to stand five minutes. The fiber slurry had previously been adjusted to pH 6.0. The fiber slurry was then used to prepare a handsheet on a Noble & Wood handsheet former. This paper was then dried by multiple passes on a drying drum held at 220° F.

Paper Testing:

After overnight equilibration, the papers were tested for wet and dry tensile strength. Wet tensile was determined by mounting the paper in the testing jaws, brushing water on the center portion of the strip and waiting 10 seconds before testing.

The absolute value of dry tensile was normalized for basis weight and compared to an untreated blank to obtain percent increase in dry tensile. The wet tensile value was similarly normalized and expressed as a percentage of the dry tensile value of that sheet.

TABLE 5

| | 1 | 2 | 3 | 4 | 5 | 6 | 7 | 8 | 9 | 10 | 11 | 12 |
|---|---|---|---|---|---|---|---|---|---|---|---|---|
| Parts polyacrylamide (solids) | 90 | 90 | 90 | 90 | 90 | 90 | 90 | 90 | 90 | 90 | | |
| Parts polyDADMAC (solids)* | 10 | 10 | 10 | 5 | 10 | 20 | 20 | 20 | 20 | 10 | | |
| Parts glyoxal (solids) | 10 | 20 | 30 | 30 | 30 | 30 | 30 | 30 | 30 | 20 | | |
| Parts tetrasodium pyrophosphate (solids) | 20 | 20 | 20 | 20 | 20 | 20 | 20 | 20 | 20 | 20 | | |
| Percent solids of mixture | 5.8 | 6.2 | 6.6 | 6.4 | 6.6 | 7.0 | 7.0 | 7.0 | 6.7 | 6.2 | — | — |
| Polyacrylamide /η/ | 0.23 | 0.23 | 0.23 | 0.23 | 0.23 | 0.23 | 0.23 | 0.23 | 0.23 | 0.13 | — | — |
| PolyDADMAC /η/ | 0.44 | 0.44 | 0.44 | 0.44 | 0.44 | 0.44 | 0.44 | 0.70 | 1.03 | 0.44 | — | — |
| Time (minutes) | 205 | 120 | 60 | 90 | 60 | 60 | 70 | 70 | 70 | 180 | — | — |
| % increase in dry tensile | 36.5 | 25.8 | 42.1 | 43.2 | 44.5 | 53.3 | 50.6 | 56.6 | 51.4 | 29.3 | 43.7 | 18.5 |
| $\frac{\text{Wet tensile}}{\text{Dry tensile}}$ (100%)** | 16.6 | 22.2 | 20.6 | 22.5 | 21.9 | 23.1 | 21.9 | 25.1 | 22.2 | 16.4 | 22.7 | 15.7 |

*Each part of polyDADMAC solids has 0.36 parts of sodium chloride associated with it as a diluent.
**Blank is equal to zero.
No. 11 is a glyoxalated acrylamide/DADMAC copolymer.
No. 12 is polyamide/polyamine/epichlorohydrin.

TABLE 6

| | Conversion of Table 5 to Weight Percent | | | | | | | | | |
|---|---|---|---|---|---|---|---|---|---|---|
| | 1 | 2 | 3 | 4 | 5 | 6 | 7 | 8 | 9 | 10 |
| Polyacrylamide (solids) | 81.8 | 75.0 | 69.2 | 72.0 | 69.2 | 64.3 | 64.3 | 64.3 | 64.3 | 75.0 |
| PolyDADMAC (solids) | 9.1 | 8.3 | 7.7 | 4.0 | 7.7 | 14.3 | 14.3 | 14.3 | 14.3 | 8.3 |
| Glyoxal (solids) | 9.1 | 16.7 | 23.1 | 24.0 | 23.1 | 21.4 | 21.4 | 21.4 | 21.4 | 16.7 |
| | 100.0 | 100.0 | 100.0 | 100.0 | 100.0 | 100.0 | 100.0 | 100.0 | 100.0 | 100.0 |
| Tetrasodium pyrophosphate (based on above) | 18.2 | 16.7 | 15.4 | 16.0 | 15.4 | 14.3 | 14.3 | 14.3 | 14.3 | 16.7 |

EXAMPLE 3

The following mixture was prepared by mixing:

5.61% polyacrylamide ($/\eta/=0.22$)
1.26% polyDADMAC ($/\eta/=0.7$)
0.46% sodium chloride
1.86% glyoxal
1.24% $Na_2HPO_4$
0.18% $NaH_2PO_4.H_2O$
89.39% soft water The pH of the mixture was 7.0. The mixture was then placed in a 40° C. constant temperature bath for 400 minutes at which time the mixture was stabilized by adjustment to pH 4.0.

A 50/50 mixture of bleached hardwood kraft/-bleached softwood kraft was treated in the manner described in Example 2. Testing was also similar.

| Product | Test Results: Increase in Dry Tensile | Wet Tensile / Dry Tensile (100%) |
|---|---|---|
| Example 3 | 46.4% | 29.9% |
| Polyamide/polyamine/epichlorohydrin | 7.8% | 24.4% |
| Glyoxalated acrylamide/DADMAC copolymer | 40.5% | 33.0% |

EXAMPLE 4

A standard recipe for formulating the cationized treating agent was as follows.

Resin Preparation

A bath was set up and the temperature of the water remained constant (40° C.±0.2° C.).

The formula below was used in the wet strength resin preparations by substituting the designated cationizers.

| Chemicals | Parts | % Weight |
|---|---|---|
| Soft $H_2O$ | | 59.58 |
| $NaHPO_4$ | 22 | 1.233 |
| $NaH_2PO_4 . H_2O$ | | .180 |
| Acrylamide | 89 | 28.030 |
| Cationizer | 20 | 6.325 |
| Glyoxal | 29 | 4.650 |
| TOTAL | 100 | 99.998 |

In the above formula, the various cationizers were substituted for 20, 10 and 5 parts in the total parts of the formula.

Additionally, the following chemicals were placed in jars in a 40° bath prior to resin make up to reach the controlled temperature.

Soft water
Acrylamide
Cationizer

Soft water was weighed into a glass jar along with $NaHPO_4$ and $NaH_2PO_4$. $H_2O$ and allowed to mix for 10 minutes. Chemicals were added one step at a time with mixing and a pH reading taken after each addition. This involved the addition of glyoxal; pH was then adjusted to 7.0 with HCl (50%) and immediately placed in the bath and subsequently this method was carried out for each polymer involved. Viscosity readings were taken periodically to check for colloid formation.

All crosslinking reactions of the resins were killed between 20–50 cps by dropping the solids to 6% and the pH to 4.0 with HCl.

The instrument used in measuring viscosity was the Brookfield Viscometer (LVF model). The number one spindle with readings at 60 RPM was used throughout the testing.

EXAMPLE 5

Procedure for Evaluation of the Wet Strength Resin

Pulp Stock:

The pulp stock used in the handsheet work was the standard wet strength stock refined to a 100 second Williams Freeness.

Formula:

50% hardwood bleached kraft
50% softwood bleached kraft

Pulp Slurry:

Based on a known pulp consistency, a measured amount of pulp was weighed and placed in the B.S.M. disintegrator along with 150 ml of Chicago tap water. The pulp stock had a 3-minute mixing time in the B.S.M. disintegrator. This procedure was carried out for each set of handsheets.

Addition of the Resin:

The wet strength resin was added to the thick stock. A three-blade prop was set approximately 0.25 inches from the bottom of the 2-liter plastic beaker containing the thick stock. The mixer was then turned on and the Rheostat was set on a maximum speed for good mixing (1,800–2,250 RPM). The wet strength resin was added directly to the thick stock at this point allowing a five-minute contact time. The thick stock was immediately poured into the proportioner of the Noble & Wood handsheet machine.

pH Adjustment:

Both the storage tank and the proportioner (containing fiber with added resin) were pH adjusted to pH 6.0 with HCl (10%) and 1N NaOH.

Handhseets:

The standard operating procedure for the Noble & Wood handsheet machine was carried out for each set of handsheets. All sets contained four 4.5 gram sheets.

Each sheet was placed on the drum dryer and allowed four alternating passes without the blotter.

All handsheets were conditioned 24 hours prior to testing. Tensile testing was done to measure improved performance.

Testing Procedure

The standard testing procedure for wet strength work was as follows:

Dry Tensile.

Four strips were cut on the Thwing-Albert J.D.C. precision sample cutter. The four strips were weighed together on the Thwing-Albert Basis Weight scale and total weight was recorded. All four strips (one from each sheet) were placed in the upper jaw of the tensile tester and clamped. The first strip was then clamped in the bottom jaw and the tensile tester was started. This was done for all four strips.

The following calculations were done to obtain the dry tensile readings:

$$DT_N = \frac{\text{Sum of Raw Data}}{BW_{DT}} \times 34.0$$

$$DT = \frac{DT\ \text{Set} - DT\ \text{Blank Set}}{DT_{Blank\ Set}} \times 100$$

Wet Tensile.

Again, four strips were cut on the J.D.C. precision cutter and weighed. One strip was clamped in the instrument jars. The strip was then swiped with a small paint brush (wetted with Chicago tap water) twice in the same direction on each side of the strip approximately in the center (horizontal) of the strip. There was a 10-second wait before starting the tensile tester. This procedure was done for each set of handsheets. All wet tensile readings were recorded and calculated using the following formula:

$$WT_N = \frac{\text{Sum of Raw Data}}{BW_{WT}} \times 34.0$$

$$W/D\ (\%) = \frac{WT_N}{DT_N} \times 100$$

The instrument used for measuring tensile strength was the Thwing-Albert Electro-hydraulic tensile tester, Model 3ZLT.

TABLE 7

| Sample (cationizer) | Dosage (#/T) Resin | Dry Tensile (Kg/in) Parts of Cationizer 5 | 10 | 20 | Wet Tensile (Kg/in) Parts of Cationizer 5 | 10 | 20 | W/D Ratio (%) Parts of Cationizer 5 | 10 | 20 |
|---|---|---|---|---|---|---|---|---|---|---|
| 1 | 15 | 77.32 | 84.50 | 80.94 | 17.33 | 16.81 | 19.63 | 22.41 | 19.87 | 24.25 |
| 2 | 15 | 78.60 | 70.88 | 68.61 | 18.18 | 14.41 | 17.46 | 23.13 | 20.33 | 25.45 |
| 3 | 15 | 66.03 | 66.48 | 66.58 | 11.09 | 12.79 | 11.65 | 16.80 | 19.24 | 17.50 |
| 4 | 15 | 63.50 | 69.88 | 73.19 | 12.19 | 10.51 | 12.63 | 19.20 | 15.04 | 17.26 |
| 5 | 15 | 64.72 | 70.13 | 71.09 | 11.06 | 12.84 | 14.84 | 17.09 | 18.31 | 20.87 |
| 1 | 20 | 87.85 | 81.21 | 85.00 | 17.71 | 18.02 | 21.29 | 20.16 | 22.19 | 25.05 |
| 2 | 20 | 85.61 | 67.22 | 75.82 | 20.34 | 18.51 | 21.51 | 23.76 | 27.54 | 28.37 |
| 3 | 20 | 66.27 | 66.88 | 67.43 | 12.82 | 15.68 | 16.29 | 19.35 | 23.44 | 24.16 |
| 4 | 20 | 66.76 | 73.01 | 71.84 | 15.94 | 15.05 | 15.22 | 23.88 | 20.61 | 21.19 |
| 5 | 20 | 64.72 | 70.13 | 71.09 | 15.57 | 13.77 | 13.88 | 22.98 | 19.80 | 19.97 |

Sample 1 = low molecular weight poly-DADMAC with viscosity approximately 0.4
Sample 2 = low molecular weight dimethyl amine epichlorohydrin copolymer
Sample 3 = low molecular weight ethylene dichloride ammonia condensation polymer
Sample 4 = higher molecular weight poly-DADMAC with viscosity approximately 0.8
Sample 5 = polyvinyl benzyl trimethyl ammonium chloride polymer

What is claimed is:

1. A composition for imparting wet and dry strength to paper fiber which comprises a blend of (1) polyacrylamide 40–95% by weight; (2) a cationic regulator selected from the group consisting of a low molecular weight dimethyl amine epichlorohydrin copolymer, a low molecular weight ethylene dichloride ammonia condensation polymer, and polyvinyl benzyl trimethyl ammonium chloride polymer in the amount of 4–14% by weight; and (3) glyoxal 2–50% by weight, and which is utilized in a dosage of 0.2–5% based on dry weight of fiber.

2. The composition of claim 1 wherein the polyacrylamide is 64–82%; the cationic regulator is 4–14%; and glyoxal is 9–24%, all in weight percent.

3. The composition according to claim 1 wherein the blend additionally contains tetrasodium pyrophosphate as a buffer.

4. A blend composition for imparting wet and dry strength to paper fibers which composition contains about 90 parts by weight of polyacrylamide; 5–20 parts by weight of a cationic regulator selected from the group consisting of a low molecular weight dimethyl amine epichlorohydrin copolymer, a low molecular weight ethylene dichloride ammonia condensation polymer, and polyvinyl benzyl trimethyl ammonium chloride polymer; 10–30 parts glyoxal; and 20 parts tetrasodium pyrophosphate.

* * * * *